United States Patent [19]

Hinshaw

[11] Patent Number: 4,802,426

[45] Date of Patent: Feb. 7, 1989

[54] METHOD OF MAKING BRAIDED RUG CONSTRUCTION

[76] Inventor: Walter L. Hinshaw, 3200 Alamance Rd., Burlington, N.C. 27215

[21] Appl. No.: 185,841

[22] Filed: Apr. 25, 1988

Related U.S. Application Data

[62] Division of Ser. No. 48,885, May 12, 1987, Pat. No. 4,764,407.

[51] Int. Cl.[4] ..... D04C 1/06; D04H 13/00; D05B 93/00

[52] U.S. Cl. ..... 112/262.1; 87/7; 87/8; 112/412; 428/37

[58] Field of Search ..... 87/5–8, 87/28–30, 33; 428/37, 102; 112/400, 401, 412, 415–417, 262.1, 266.1, 266.2

[56] References Cited

U.S. PATENT DOCUMENTS

| | | | |
|---|---|---|---|
| 1,692,651 | 11/1928 | Greenspan | 87/7 |
| 3,153,366 | 10/1964 | Iwai | 87/7 |
| 3,185,119 | 5/1965 | Choshi | 112/412 |
| 3,323,406 | 6/1967 | Mitchell | 87/7 |
| 3,338,129 | 8/1967 | Mitchell et al. | 87/7 |
| 3,390,602 | 7/1968 | Ohno | 87/7 |
| 3,405,598 | 10/1968 | Iwai | 112/412 X |
| 3,421,405 | 1/1969 | Logrippo | 87/7 X |
| 3,481,245 | 12/1969 | Kamitani | 112/412 X |

*Primary Examiner*—John Petrakes
*Attorney, Agent, or Firm*—B. B. Olive

[57] ABSTRACT

A braided rug method and construction is based on securing by stitching a relatively small auxiliary strand over the junction of large stitched together strands of braid. By selection of auxiliary strand color, alternating the side of the rug on which the auxiliary strand appears or by employing auxiliary strands on both sides of the rug new appearances in braided rug color, texture and appearance are achieved.

7 Claims, 1 Drawing Sheet

FIG. 1
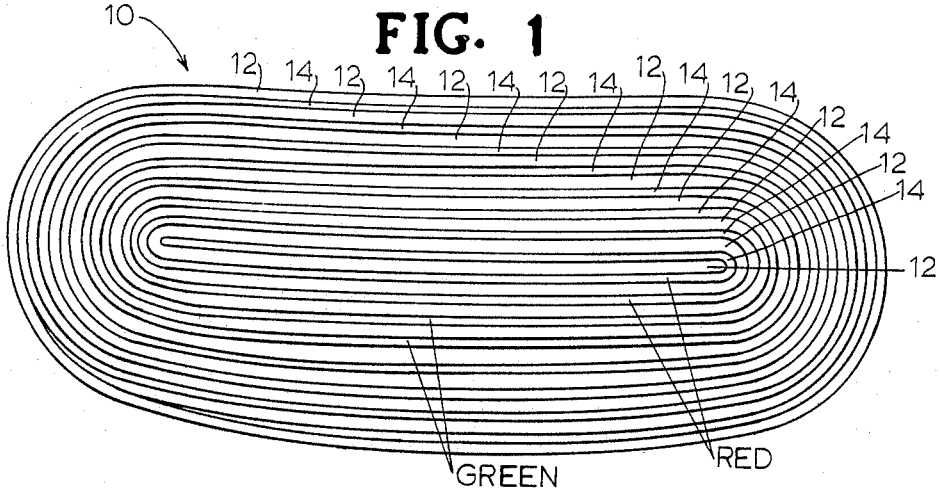
FIG. 2
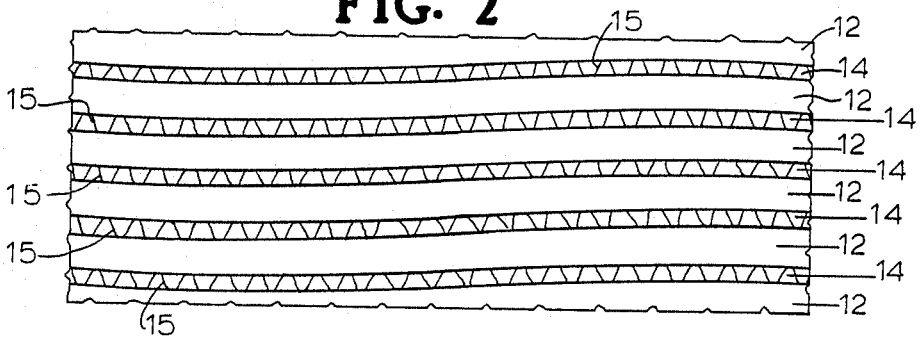
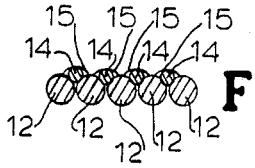
FIG. 3
FIG. 4
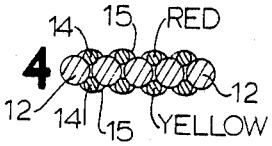
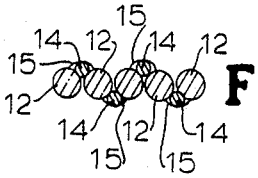
FIG. 5
FIG. 6
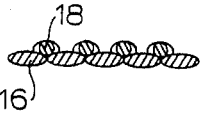

METHOD OF MAKING BRAIDED RUG CONSTRUCTION

REFERENCE TO RELATED APPLICATION

This is a division of U.S. application Ser. No. 07/048,885 filed May 12, 1987, now U.S. Pat. No. 4,764,407.

BACKGROUND OF THE INVENTION

1. Technical Field

The invention relates broadly to rugs but more specifically to methods and constructions related to rugs commonly referred to as braided rugs.

2. Background Art

The type of floor rug typically referred to in the trade as a braided rug is made in some selected round, oval, elliptical, rectangular or other shape by coiling a strand of braid in the shape desired starting from the inside then working out. The strands are typically held together by a zig-zag type lock stitch and the braid may be in various solid or variegated colors to meet the desires of the consumers. The strand typically referred to as the braid may actually be in the form of a platted or braided strand and may include a filler within the braid to increase the bulk or body of the strand. The strands may also be substantially round in cross-section or may be of an oval or substantially flat construction.

Variety in appearance or color has generally been obtained by varying the nature of the strand of braid used to form the rug. With increasing consumer demand for braided rugs, there is thus an increasing consumer demand for more variety in texture, color and appearance. Thus, the present invention has for its primary object the provision of a new braided rug construction and method of making a braided rug to provide choices of color, appearance and texture not heretofore achieved in the braided rug art. Other objects will appear as the description proceeds.

DISCLOSURE OF THE INVENTION

The braided rug method and construction of the invention is based on adding and stitching in a relatively small yarn, cord, braid, roving, plastic molded strand or the like in the valley or "V" between but on the outer surface of adjoining strands of the substantially larger braid used to form the rug. This auxiliary small strand is secured to the adjacent larger strands by the same thread employed to hold the larger strands togther. By choosing contrasting colors or textures for the auxiliary small strand in contrast to the larger strand used to form the rug there is achieved a wide choice in both color, texture and appearance of the braided rug.

DESCRIPTION OF DRAWINGS

FIG. 1 is a plan view of a braided rug made according to the invention.

FIG. 2 is an enlarged plan view of a typical section of the rug of FIG. 1.

FIG. 3 is a cross-section view illustrating the relation of the relatively small auxiliary strand to the larger rug braid strand when the auxiliary strand is placed on only one side of the rug with the braid strand being of circular cross-section.

FIG. 4 illustrates a pair of auxiliary strands placed on opposite sides of the rug.

FIG. 5 illustrates a single auxiliary strand alternating from one side of the rug to the other throughout the construction.

FIG. 6 illustrates the auxiliary strand applied to a relatively flat tape-like braid.

BEST MODE FOR CARRYING OUT THE INVENTION

Making reference initally to FIGS. 1–3 and the first embodiment of the invention, the braided rug 10 of the invention is made up by coiling a conventional strand of braid 12 and laying in along the junction of and adjacent adjoining strands of the coiled braid 12 a relatively small auxiliary strand 14 in the nature of a relatively small yarn, cord, braid or the like. The size of the relatively small auxiliary strand 14 is selected such that it tends to lay in the valley or "V" between the adjacent larger braid strands 12 as best seen in FIG. 3. A zig-zag type lock stitch thread 15 conventional to the trade is employed with the top thread of the stitch effectively overlying and locking in the auxiliary strand 14 to the larger strands of braid 12.

What is particularly unique about the method and construction of the invention is the fact that the relatively small auxiliary strand 14 can be of a contrasting color or texture relative to the color or texture of the relatively large braid 12. Thus as somewhat schematically illustrated in FIG. 1 the center area of the rug 10 may employ a red auxiliary strand 14, the next adjoining area a green auxiliary strand 14 and the outer area a red auxiliary strand 14. An interesting and attractive color pattern is thus achieved that contrasts with whatever color is presented by the larger braid 12.

In an alternative second embodiment of FIG. 4, auxiliary strands 14 are placed on both sides of the rug and occupy the opposed valleys inherent between adjacent braid strands 12 illustrated as being of substantially circular cross-section. Thus, if the auxiliary strands 14 are red on one side as depicted and yellow on the opposite side, the user of the rug can obtain a substantially different appearance by simply turning the rug over. In this second embodiment it has been found that one auxiliary strand can be captured by the bobbin thread and the other auxiliary strand captured by the needle thread.

In a third embodiment illustrated in FIG. 5, the auxiliary strand 14 alternates between being on one side of the rug and the other thus adding to variety in appearance and color.

While it is presently believed that the method and construction of the invention will find its widest application to braided rugs formed of braid of substantially circular cross-section, it has also been found as depicted in FIG. 6 in a fourth embodiment that the method and construction of the invention lends itself to a braided rug formed of relatively large, flat tape-like braid 16 with a smaller layed-in auxiliary strand 18. The term "braid" as used herein is thus intended to refer to the conventional types of strands used for the conventional so-called braid rug whether technically braided, platted or otherwise.

The fabrication of the rug 10 of the invention is started in conventional manner by coiling the conventional braid 12 from inside out and utilizing a zig-zag lock stitch. The needle and bobbin threads can be of suitable size, type or color. In one embodiment, the needle yarn was a monofilament, transparent, nylon thread and the bobbin thread was a grey, spun, "Dacron" thread. When the assembly fabrication is started the added small yarn, cord, braid or the like employed as the auxiliary strand 14 is laid in the valley or "V" between but outside of the junction of the adjacent larger braids 12. It has been found that the smaller auxiliary strand 12 seeks to position itself in the valley between the larger strands of braid 12. When starting to sew, the auxiliary strand 14 is initially anchored by a few stitches to the larger braid strand 12 so that the auxiliary strand 14 is pulled under the machine presser foot evenly and at the same time as the larger braid strand 12. The length and width of the stitch are determined according to the specific characteristics of rug being made.

What has thus been achieved is a dramatic increase in the choice of color, texture and appearance for the braided type rug. While an oval shape has been depicted in FIG. 1, it will of course be appreciated that braided rugs may be made in round, rectangular, square or other shapes of the users choice. While the exact dimensions of the braid 12 and the auxiliary strand 14 may vary, in one embodiment the braid 12 had a filling within the braid and was approximately one half inch in diameter whereas the auxiliary strand 14 was a small braided cord approximately one eighth inch in diameter. By varying the color of the auxiliary strand 14 in different areas of the rug 10, an extremely interesting color and texture effect was achieved.

What is claimed is:

1. The method of making a braid type rug, comprising:

(a) starting with one end of a strand of braid at the center of the rug, coiling the braid to form a rug of selected size and shape;

(b) starting with one end of a first auxiliary strand substantially smaller in size than said braid and secured by stitches to said one end of the braid, coiling said auxiliary strand such that said auxiliary strand in relation to said braid lies outside but immediately adjacent the junction of and between and parallel to adjacent strands of said braid and exposed to view; and (c) stitching said braid and auxiliary strand together to retain said braid and auxiliary strand in said relation throughout the portion of the rug in which said auxiliary strand is employed.

2. The method of claim 1 wherein the color of said auxiliary strand is selected so as to change in various portions of said rug.

3. The method of claim 1 wherein said auxiliary strand alternates between being on one side and the other of said rug.

4. The method of claim 1 including a second auxiliary strand similarly placed and stitched as said first auxiliary strand but on an opposite side of said rug.

5. The method of claim 4 wherein said first and second auxiliary strands are selected to be of different color.

6. The method of claim 1 wherein said braid is selected to be of substantially circular cross-section.

7. The method of claim 1 wherein said braid is selected to be of substantially flat, tape-like cross-section.

* * * * *